US009916823B2

(12) United States Patent
Griswold et al.

(10) Patent No.: US 9,916,823 B2
(45) Date of Patent: Mar. 13, 2018

(54) GRADIENT WAVEFORMS DERIVED FROM MUSIC

(71) Applicant: Case Western Reserve University, Cleveland, OH (US)

(72) Inventors: Mark Griswold, Shaker Heights, OH (US); Dan Ma, Cleveland, OH (US)

( * ) Notice: Subject to any disclaimer, the term of this patent is extended or adjusted under 35 U.S.C. 154(b) by 3 days.

(21) Appl. No.: 14/258,064

(22) Filed: Apr. 22, 2014

(65) Prior Publication Data

US 2015/0302842 A1 Oct. 22, 2015

(51) Int. Cl.
*G10H 3/08* (2006.01)
*G10H 3/12* (2006.01)

(52) U.S. Cl.
CPC ..... *G10H 3/12* (2013.01); *G10H 2220/371* (2013.01); *G10H 2220/461* (2013.01)

(58) Field of Classification Search
CPC ..... G10H 3/12
USPC ..... 84/641
See application file for complete search history.

(56) References Cited

U.S. PATENT DOCUMENTS 5,709,207 A * 1/1998 Duerk ..... G01R 33/283 324/307
2012/0249137 A1* 10/2012 Witschey ..... G01R 33/3875 324/309

* cited by examiner

*Primary Examiner* — Jianchun Qin
(74) *Attorney, Agent, or Firm* — Quarles & Brady LLP

(57) ABSTRACT

Apparatus, methods, and other embodiments associated with producing gradient waveforms derived from music are provided. A piece of encoded music (e.g., MP3 file) is converted to an encoding gradient associated with a magnetic resonance fingerprinting (MRF) pulse sequence. The encoding gradient may be optimized with respect to maximum gradient amplitude, gradient slew rate, and other properties of a magnetic resonance (MR) apparatus that will perform the MRF pulse sequence. The MR apparatus may then be controlled to perform an MRF procedure using the encoding gradient. Performing the MRF procedure using the encoding gradient may cause the MR apparatus to reproduce the piece of encoded music. The encoding gradient may be manipulated (e.g., rotated) to encode additional lines in k-space.

33 Claims, 18 Drawing Sheets

GRADIENT WAVEFORMS DERIVED FROM MUSIC

FEDERAL FUNDING NOTICE

The invention was developed with federal funding supplied under Federal Grant No 1RO1EB017219 provided by the NIH. The Federal Government has certain rights in the invention.

BACKGROUND

Acoustic noise is produced during magnetic resonance (MR) scans. The acoustic noise may be, for example, loud banging sounds caused by the production of readout gradients. The noise may be uncomfortable for patients, technicians, doctors, and anyone else in the vicinity of the MR apparatus. Indeed, loud banging may be disconcerting or even unnerving for a patient who is already nervous about being "in the bore" to have some condition (e.g., torn knee, cancer) evaluated.

Previous attempts have been made to intersperse MR readout gradients with music. See, for example, R. Loeffler, Proc. Intl. Soc. Mag. Reson. Med, 10 (2002). Conventionally it may have been difficult, if even possible at all, to simulate music due to the fixed sequence blocks and invariant pulse sequences associated with traditional MR acquisitions.

Conventionally, given a digital music file (e.g., MP3), its trajectory could be analyzed and "music" could be generated using a gradient where the gradient was produced by optimizing:

$$\min(\|G-s\|_2+\lambda\Sigma G)+G_M$$

where G is a target gradient, s is a music segment, $\lambda$ is used to balance gradient fidelity, refocusing, and trajectory coverage, and $G_M$ is a gradient moment.

Magnetic resonance fingerprinting (MRF) employs a series of varied sequence blocks that simultaneously produce different signal evolutions in different resonant species (e.g., tissues) to which the radio frequency (RF) energy is applied. The term "resonant species", as used herein, refers to an item (e.g., water, fat, tissue, material) that can be made to resonate using NMR. By way of illustration, when RF energy is applied to a volume that has bone and muscle tissue, then both the bone and muscle tissue will produce an NMR signal. However the "bone signal" and the "muscle signal" will be different and can be distinguished using MRF. The different signals can be collected over a period of time to identify a signal evolution for the volume. Resonant species in the volume can then be characterized by comparing the signal evolution to known evolutions. Characterizing the resonant species may include identifying a material or tissue type, or may include identifying MR parameters associated with the resonant species. The "known" evolutions may be, for example, simulated evolutions or previously acquired evolutions. A large set of known evolutions may be stored in a dictionary. Characterizing the resonant species can include identifying different properties of a resonant species (e.g., T1, T2, diffusion resonant frequency, diffusion co-efficient, spin density, proton density). Additionally, other properties including, but not limited to, tissue types, materials, and super-position of attributes can be identified. These properties may be identified simultaneously using MRF, which is described in United States Patent Application "Nuclear Magnetic Resonance (NMR) Fingerprinting", application Ser. No. 13/051,044, and in *Magnetic Resonance Fingerprinting*, Ma et al., Nature 495, 187-192 (14 Mar. 2013), the contents of both of which are incorporated herein by reference.

BRIEF DESCRIPTION OF THE DRAWINGS

The accompanying drawings, which are incorporated in and constitute a part of the specification, illustrate various example systems, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

Music that is coordinated with the production of readout gradients may mitigate acoustic noise issues (e.g., knocking) associated with conventional MR scans to provide an improved experience for the patient. Example apparatus and methods may use the acoustic waveform associated with a particular piece of music to select gradient waveforms for an MRF pulse sequence. Using the gradient waveforms in an MRF approach facilitates quantifying multiple tissue parameters without producing the uncomfortable acoustic noises. The extra degrees of freedom available in MRF allow the design of pulse sequences that will replicate music in the magnet, which may make the patient more comfortable and thus more compliant.

In one embodiment, an electronic music file (e.g., MP3) is directly converted to a readout encoding gradient. The readout encoding gradient is used with varying flip angles and repetition times (TR) in an MRF acquisition to simultaneously quantify MR parameters including T1, T2, off-resonance, and proton density all while producing a less disturbing or even pleasing sound for the patient.

Example MRF apparatus and methods use music-derived waveforms for encoding during readout. Encoded music in, for example, an MP3 format, may be converted to encoding gradients and optimized. In one embodiment, an encoding gradient may account for gradient moment nulling for steady state free precession (SSFP) readouts. The gradient waveforms are then used in MRF in combination with variable flip angles (FAs) and repetition times (TRs) to simultaneously quantify T1, T2, M0, or off-resonance.

Figure 1:
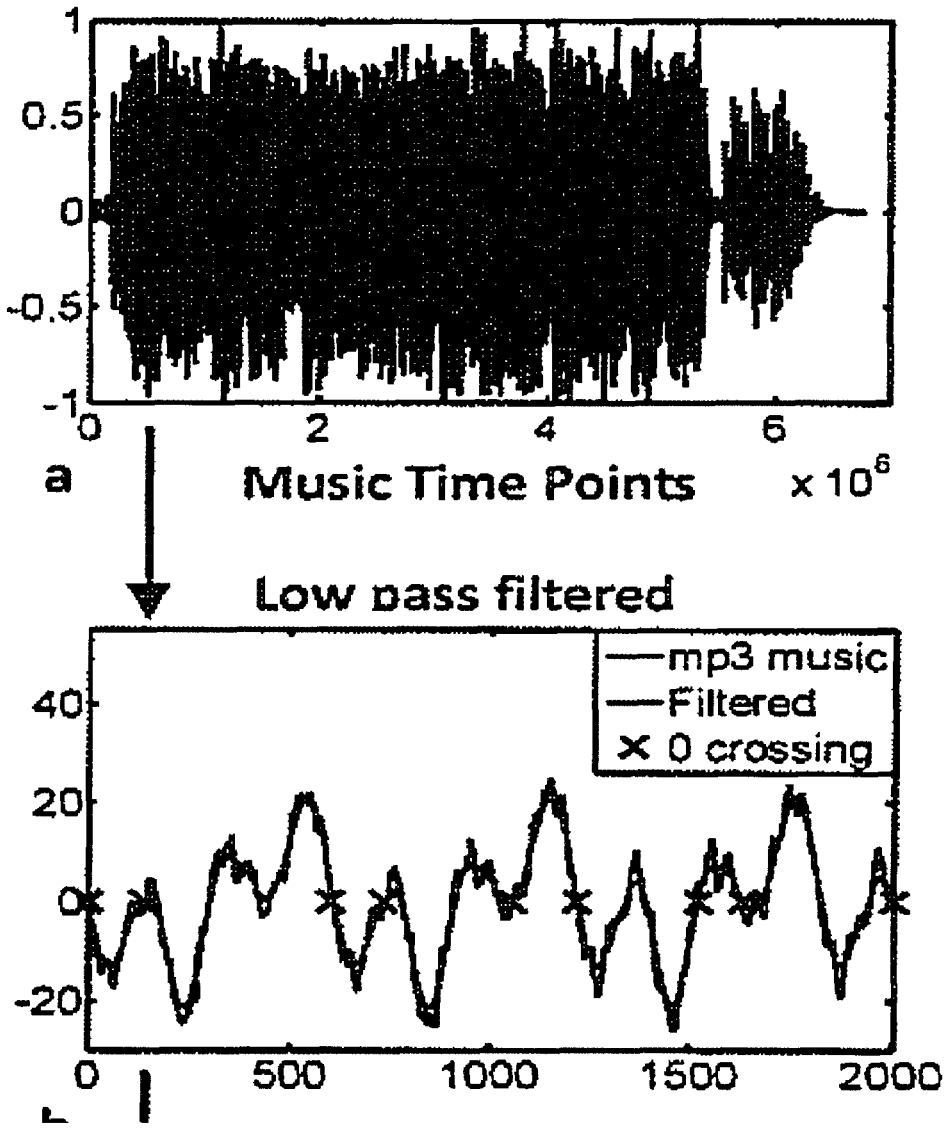
FIG. 1 illustrates producing low pass filtered music.
Figure 2:
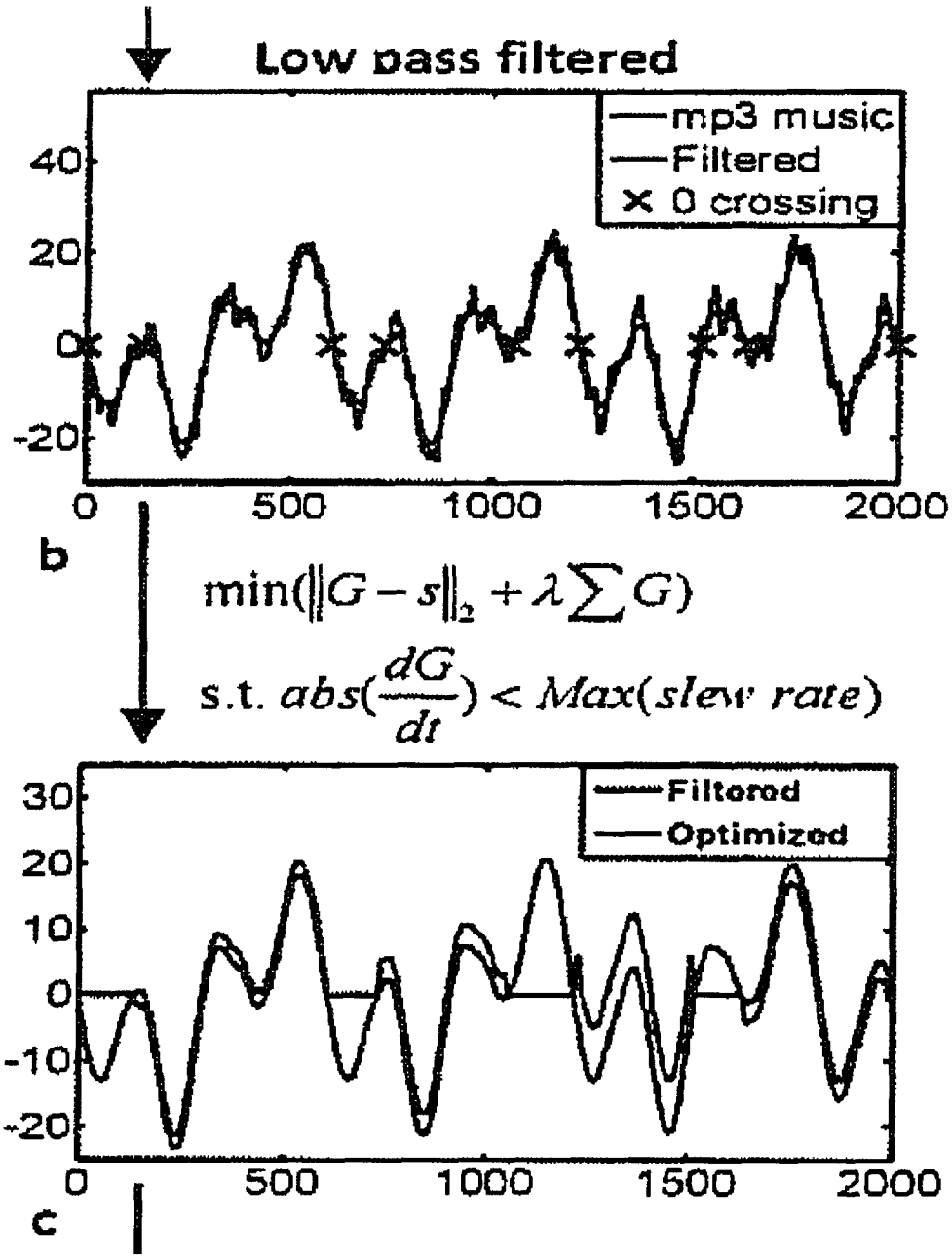
FIG. 2 illustrates producing resampled music from low pass filtered music.
Figure 3:
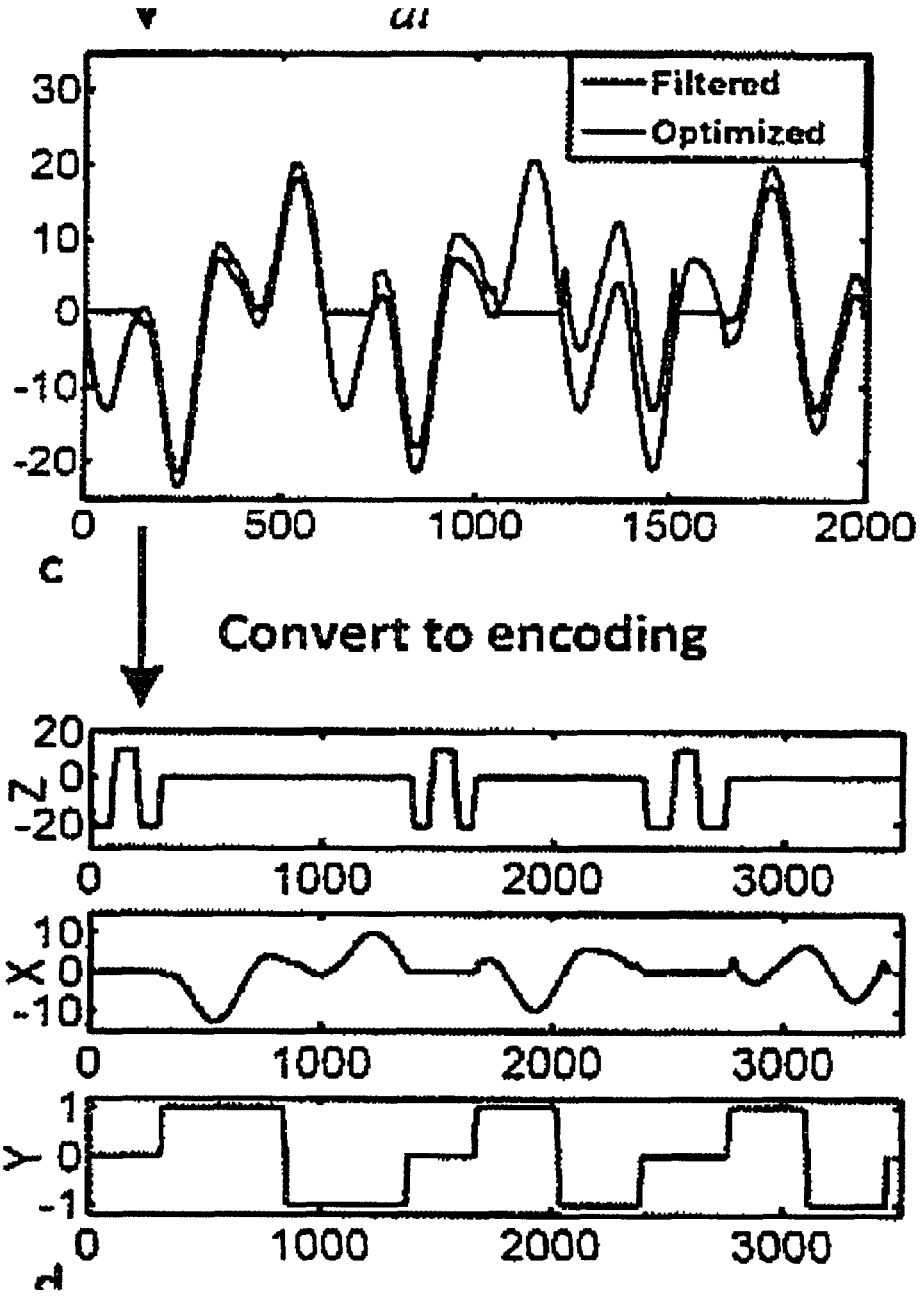
FIG. 3 illustrates converting resampled music to an encoding gradient.

The encoded music may first be low-pass filtered to, for example, 2 KHz to remove high frequency oscillations that may be reproducible by a gradient. The low pass filtered music may then be resampled to, for example, 100 Khz. The low pass filtered music may be resampled to match, for example, a gradient output raster time. While filtering and then resampling is described, in one embodiment the encoded music may be resampled then filtered. In other embodiments, the encoded music may be pre-processed in other ways and in other orders. FIG. 1 illustrates producing low pass filtered music. FIG. 2 illustrates producing resampled music from the low pass filtered music. The resampled music may then be converted to an encoding. FIG. 3 illustrates converting the resampled music to an encoding.

In one embodiment, when an SSFP-based MRF sequence is employed, an encoding gradient for a TR of the MRF sequence may be designed to start and end at the center of k-space. To account for starting and ending at the center of k-space, zero crossings of the resampled music may be located to facilitate partitioning the music into a plurality of segments.

In one embodiment, odd numbered segments may be used for RF excitation and slice selection gradients (z). These odd numbered segments may have zero amplitude in both phase (Y) and frequency (X) encoding directions. The even numbered segments may then be used for k-space encoding gradients. In one embodiment, the role of the even and odd numbered segments may be reversed. In one embodiment, subsets of music segments may be used for RF excitation and slice selection gradients (z) and other disjoint subsets of music segments may be used for k-space encoding gradients.

In one embodiment, encoding gradients may be solved for using an optimization. The optimization may be designed to satisfy scanner specific constraints with respect to maximum gradient amplitude and maximum slew rate. The optimization may also be designed to yield $0^{th}$ moment compensation. The optimization may also be designed to generate sampling trajectories to cover N×N (e.g., 128×128) pixels in an $Mmm^2$ (e.g., 300 $mm^2$) field of view (FoV).

The optimization may be performed on, for example, a one dimensional waveform. Although the optimization may initially be performed on a one dimensional waveform, example apparatus and methods may seek to encode more than a single line in k-space. Therefore, in one embodiment, low frequency balanced trapezoidal gradients with a certain percentage (e.g., 10%) of the maximum amplitude of the music encoding gradients may be designed. The music encoding gradients and the low frequency gradients may then be rotated from TR to TR so that images have different spatial encodings without altering the sound of the music.

Figure 4:
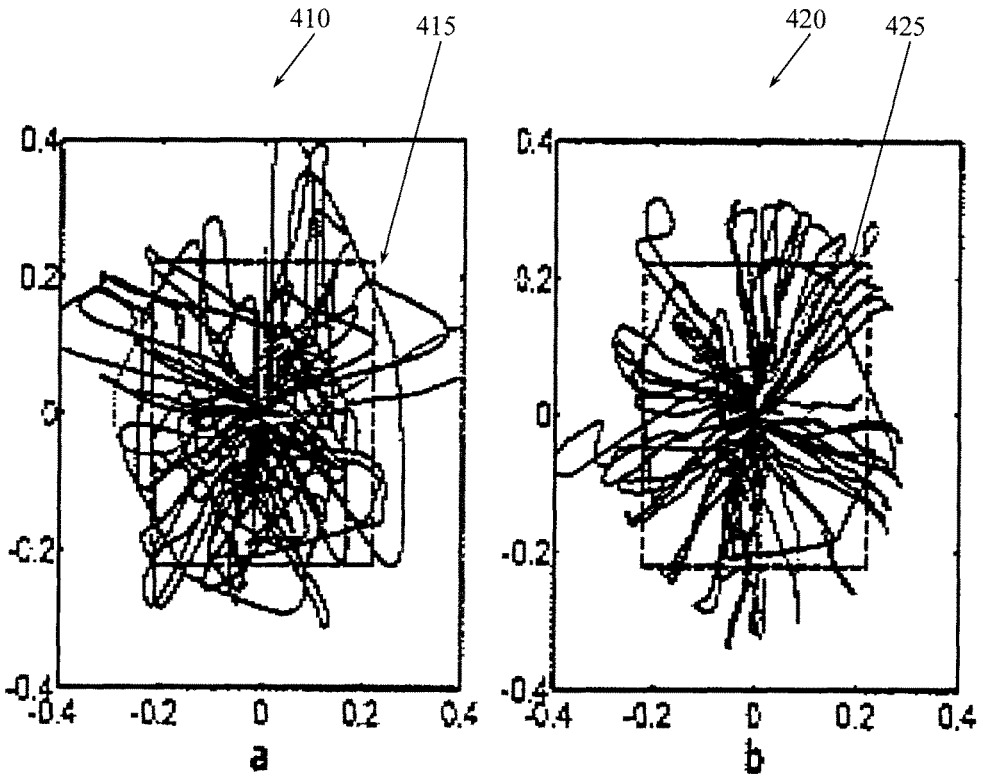
FIG. 4 illustrates k-space trajectories produced from popular pieces of music.

TRs for MRF acquisitions are inherently random because the length of the encoding gradients depends on the duration of the corresponding music segment. The gradient waveforms therefore produce k-space trajectories that are dependent on the music (e.g., song) from which they are derived. For example, FIG. 4 shows example trajectories 410 and 420 derived from two popular songs. The squares 415 and 425 enclose sample points that may be used in a reconstruction.

Example apparatus and methods were tested using in-vivo experiments. In one experiment, a total of five repetitions of the music sequence were made and 4,000 data points were acquired. The trajectories were rotated 111.2 degrees from TR to TR. The data was acquired in just five minutes. Other numbers of repetitions, numbers of data points, and rotations may be employed.

Under-sampled images were reconstructed using non-uniform fast Fourier transforms (NUFFT). Signal evolutions from the reconstructed under-sampled images were used to quantify T1, T2, M0, and off-resonance as described in Ma et al., Nature 495, 187-192 (14 Mar. 2013). White matter (WM), gray matter (GM), and cerebrospinal fluid (CSF) regions of interest were selected from the resultant T1 and T2 maps. The mean values of T1 and T2 obtained from the regions of interest were calculated and compared to known values.

The optimization can be solved and applied to one dimensional (1D) music waveforms. For two dimensional (2D) coverage, music segments or gradients may be rotated by a certain amount (e.g., 0.9 degrees) from TR to TR. Different rotation amounts may be employed in different examples. Also, rotations may be performed on less than a per TR basis. For three dimensional (3D) coverage, music segments or gradients may be rotated by applying 3D rotational angles. Different 3D rotational angles may be employed in different examples.

Example apparatus and methods may seek to have a zero total moment gradient for a TR. Therefore, a rewinding gradient may be added after the optimization of a waveform for a TR to compensate for the residual momentum from a music segment in a TR. In one embodiment, an additional compensating moment is added as a short gradient waveform at the end of the readout gradient according to:

$$\Sigma G_r t_r = -\Sigma G_t.$$

This gradient may be kept short enough (e.g., 20 μs) to remain below the audible range.

Figure 5:
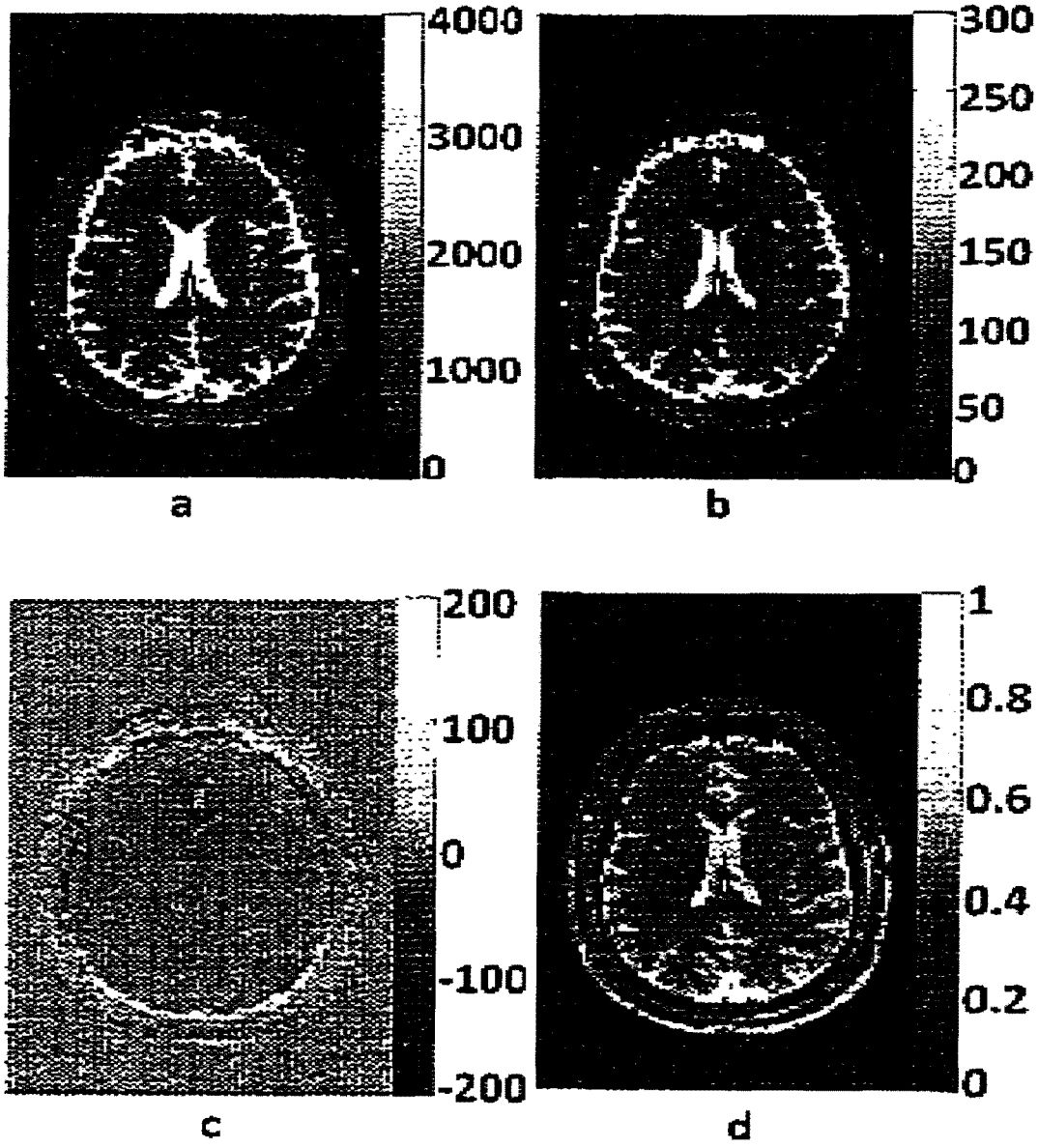
FIG. 5 illustrates in vivo results produced by example apparatus and methods.

FIG. 5 illustrates four maps produced by an in-vivo experiment using MRF. The sound generated at the scanner resembled the original music and was recognizable by the volunteer in the scanner. Mean values for T1 and T2 from typical regions in the brain agreed with known values.

In one embodiment, the gradient waveforms and thus the sound was generated by optimizing:

$$\min(\|G-s\|_2+\lambda\Sigma G+\beta\|K-K_0\|_2)$$

where G is a target gradient, s is a music segment, K is the vector of sampling points derived from the music segment s, $K_0$ is the vector of equally distributed points between −Kmax and Kmax, and λ and β balance gradient fidelity, gradient refocusing, and trajectory coverage. K may be derived from s using, for example, $K=\bar{\gamma}\Sigma G_t$. Kmax may be, for example, the resolution divided by 2 divided by the field of view (FoV). K represents what is actually covered and $K_0$ represents desired coverage. The gradient may be optimized when $K=K_0$. The gradient may be manipulated so that $$\text{abs}\left(\frac{dG}{dt}\right) < \max(\text{slew rate}).$$

Zero total gradients may be desired. Optimizing the gradient may produce nearly zero gradients, but not exactly zero gradients. Therefore, to get even closer to an exactly zero gradient, a gradient moment may be added. In one embodiment, the optimization includes gradient moments:

$$\min(\|G-s\|_2+\lambda\Sigma G+\beta\|K-K_0\|_2)+Gm$$

In one embodiment, the gradient moments Gm may be, for example:

$$\Sigma G_r t_r=-\Sigma G_t.$$

The gradient may be solved for in one dimension, and then rotations or other manipulations may be employed to retrieve additional information. For example, the gradient may be rotated to get 2D or even 3D information.

Figure 6:
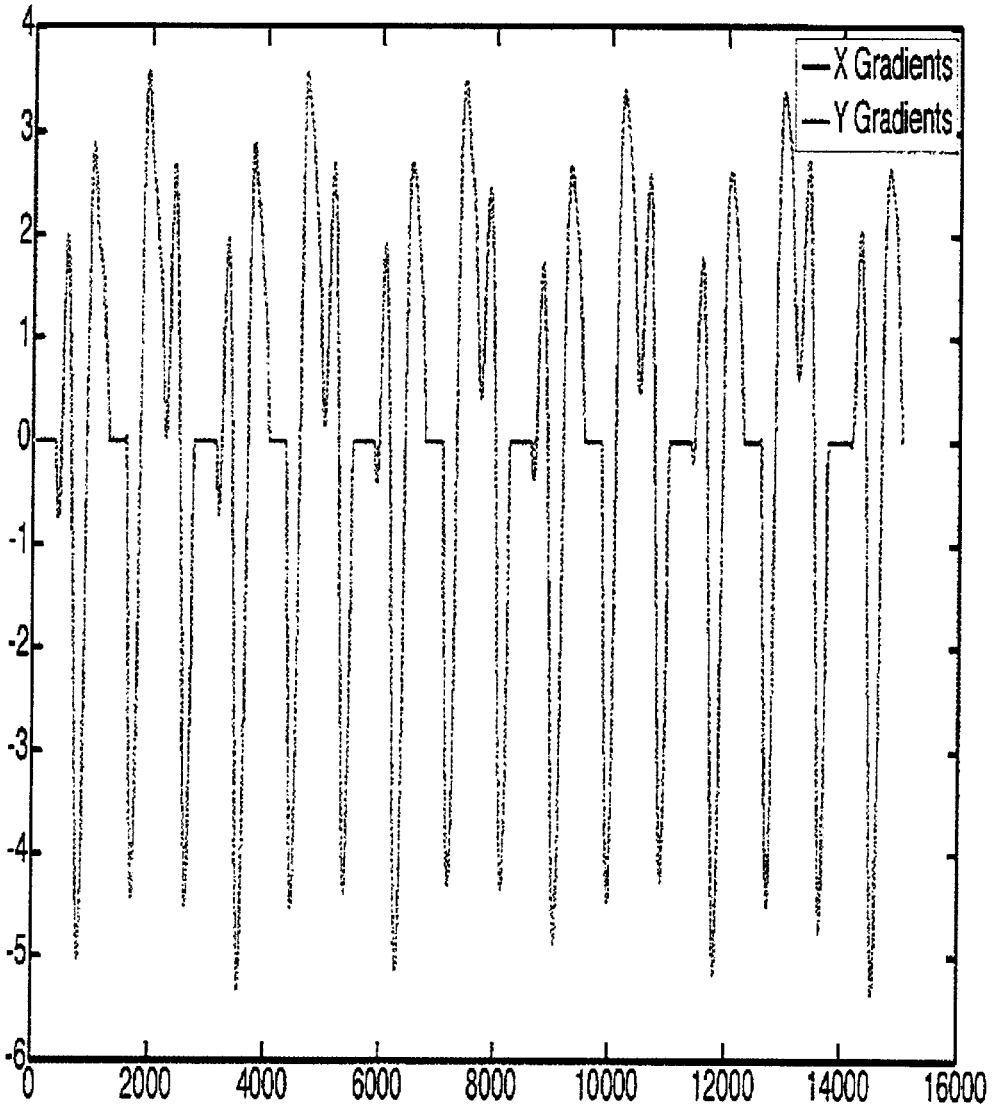
FIG. 6 illustrates example gradients associated with 2D radial trajectories.
Figure 7:
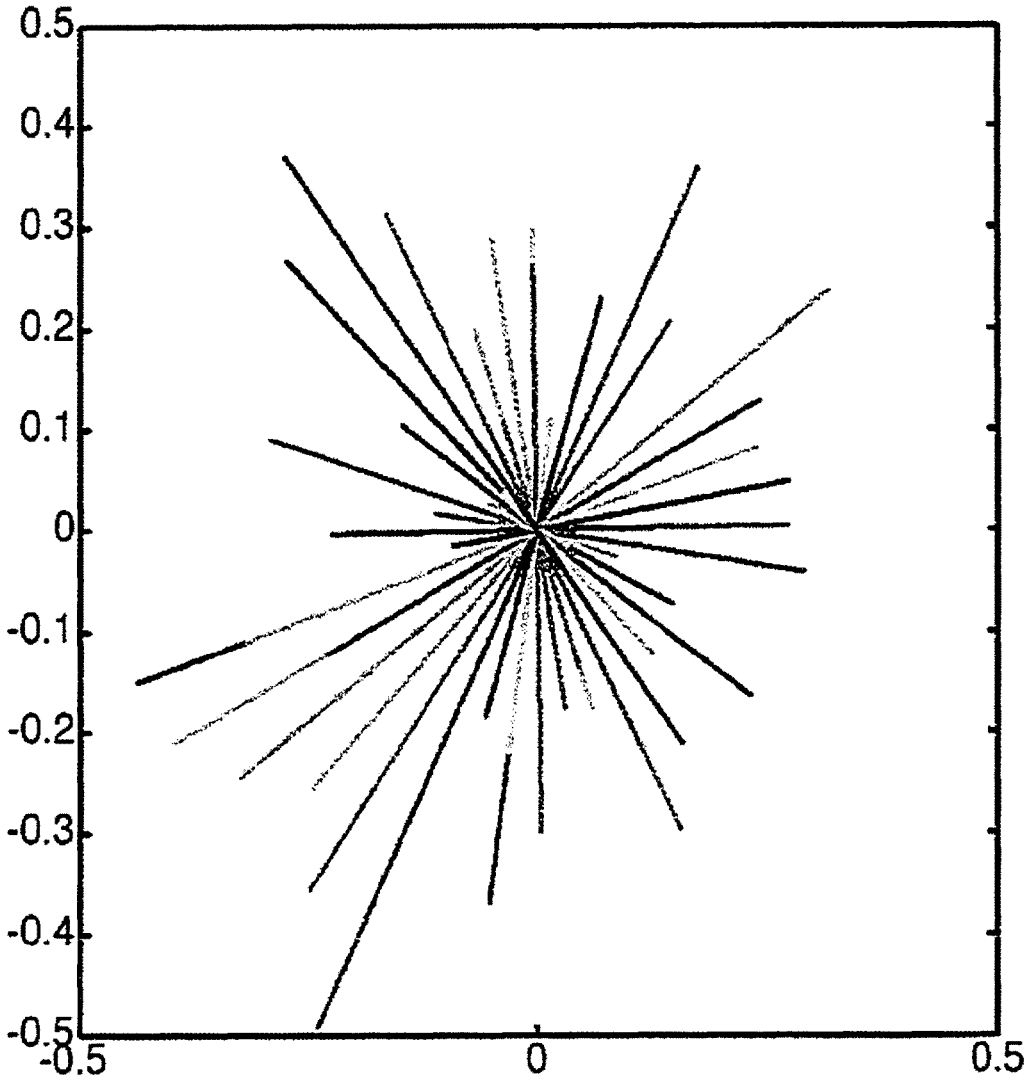
FIG. 7 illustrates example trajectories associated with 2D radial trajectories.

While rotations of an original gradient are described, other modified trajectories may be employed. For example, switched gradients orthogonal to music waveforms may be employed. FIG. 6 illustrates example gradients and FIG. 7 illustrates example trajectories associated with a 2d radial trajectory. In one example 2d radial trajectory, a first subset of segments (e.g., odd numbered) apply RF excitation and a slice selection gradient (Z) while a second subset (e.g., even numbered segments) apply phase encoding (X) and frequency encoding (Y).

Figure 8:
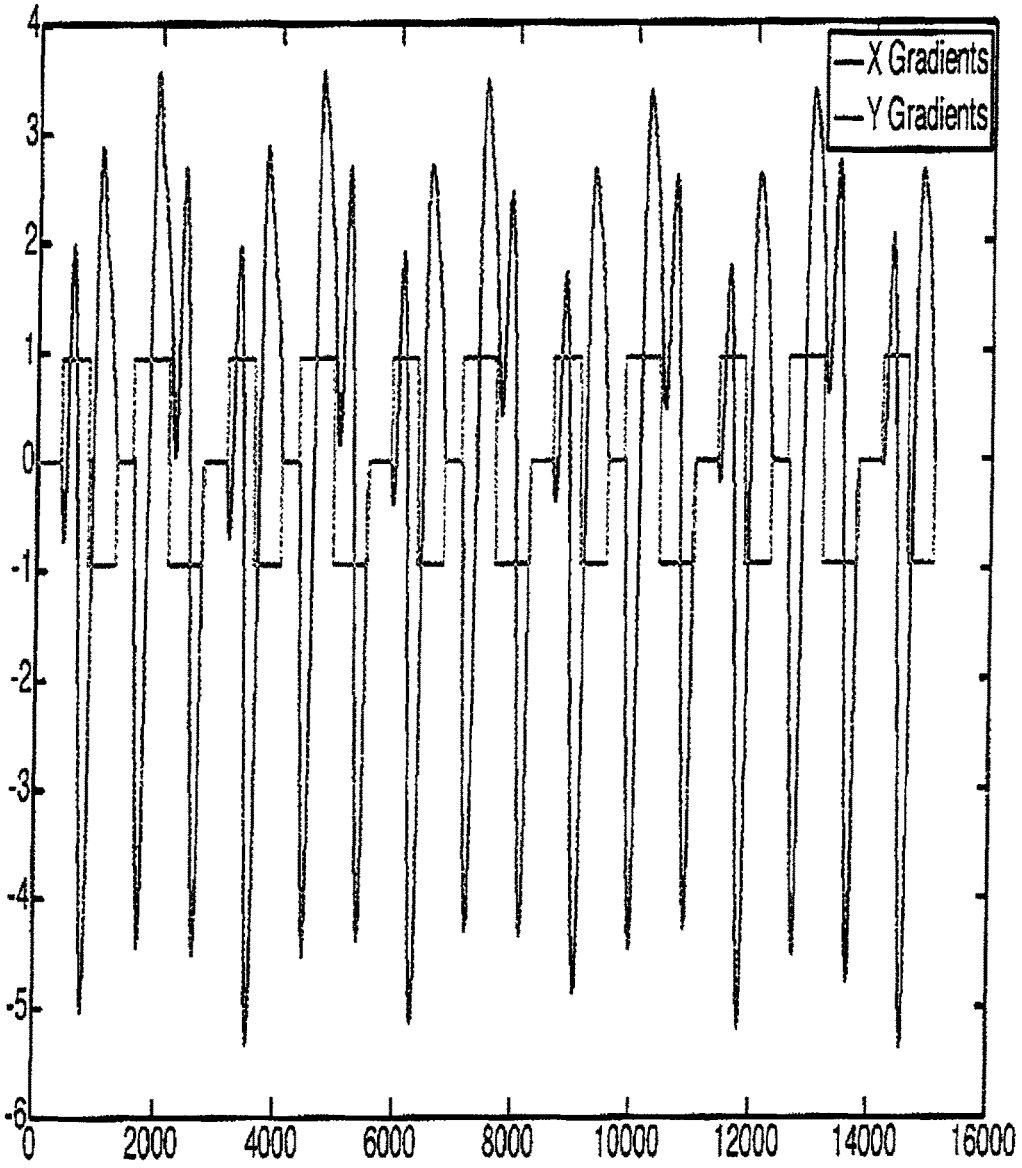
FIG. 8 illustrates example gradients slowly switched in the orthogonal direction.
Figure 9:
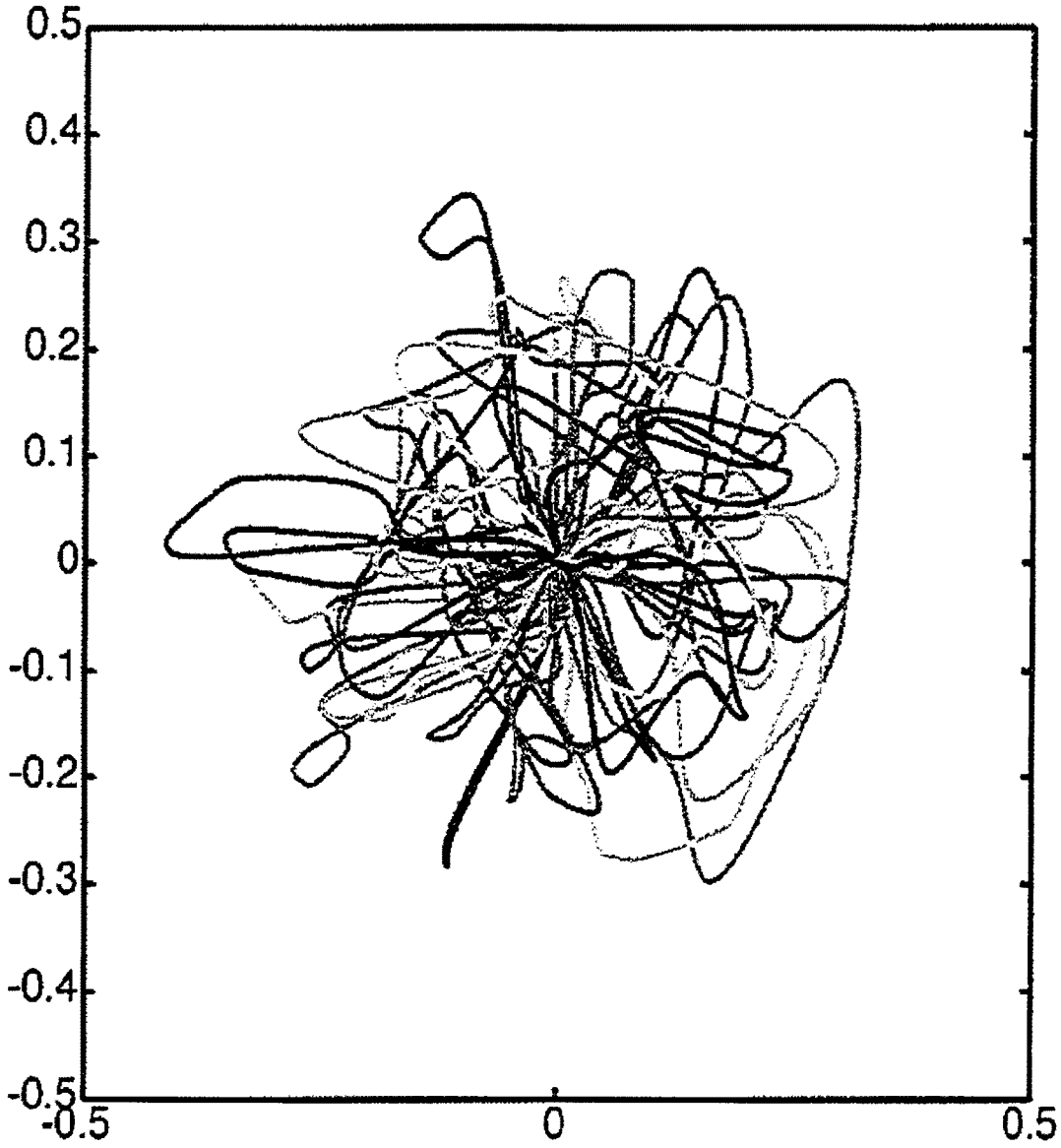
FIG. 9 illustrates example trajectories associated with gradients slowly switched in the orthogonal direction.

FIG. 8 illustrates example gradients and FIG. 9 illustrates example trajectories associated with gradients being switched in orthogonal directions. In one embodiment, the X gradient is used for a music waveform and the Y gradient is used for a trapezoidal waveform. In a TR, the trapezoidal gradient may have the same duration as the music waveform. The ramp up time of gradients may be fixed to, for example, 100 μs. The amplitude of the trapezoidal gradient may be, for example, 0.1 times the minimum amplitude of the music waveform.

Figure 10:
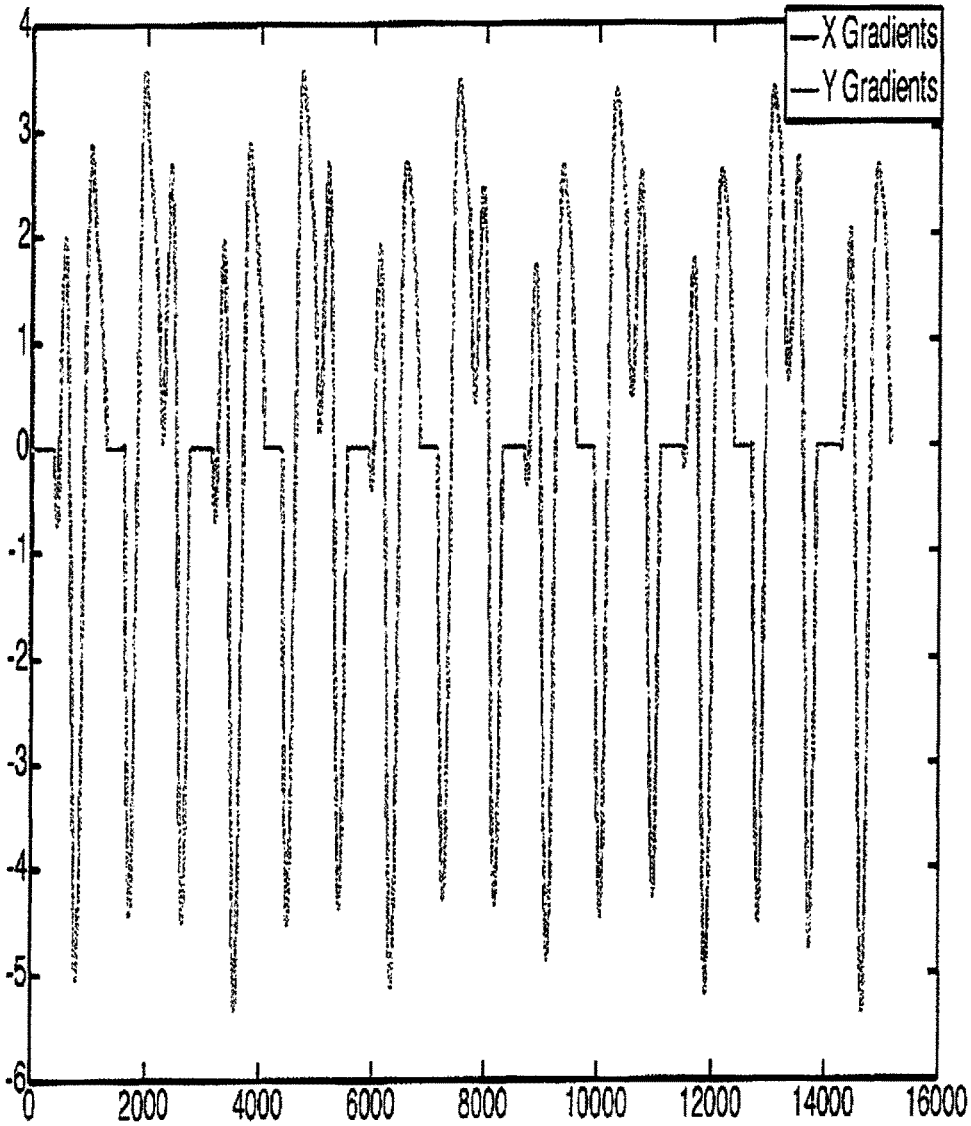
FIG. 10 illustrates example gradients associated with shifted waveforms.
Figure 11:
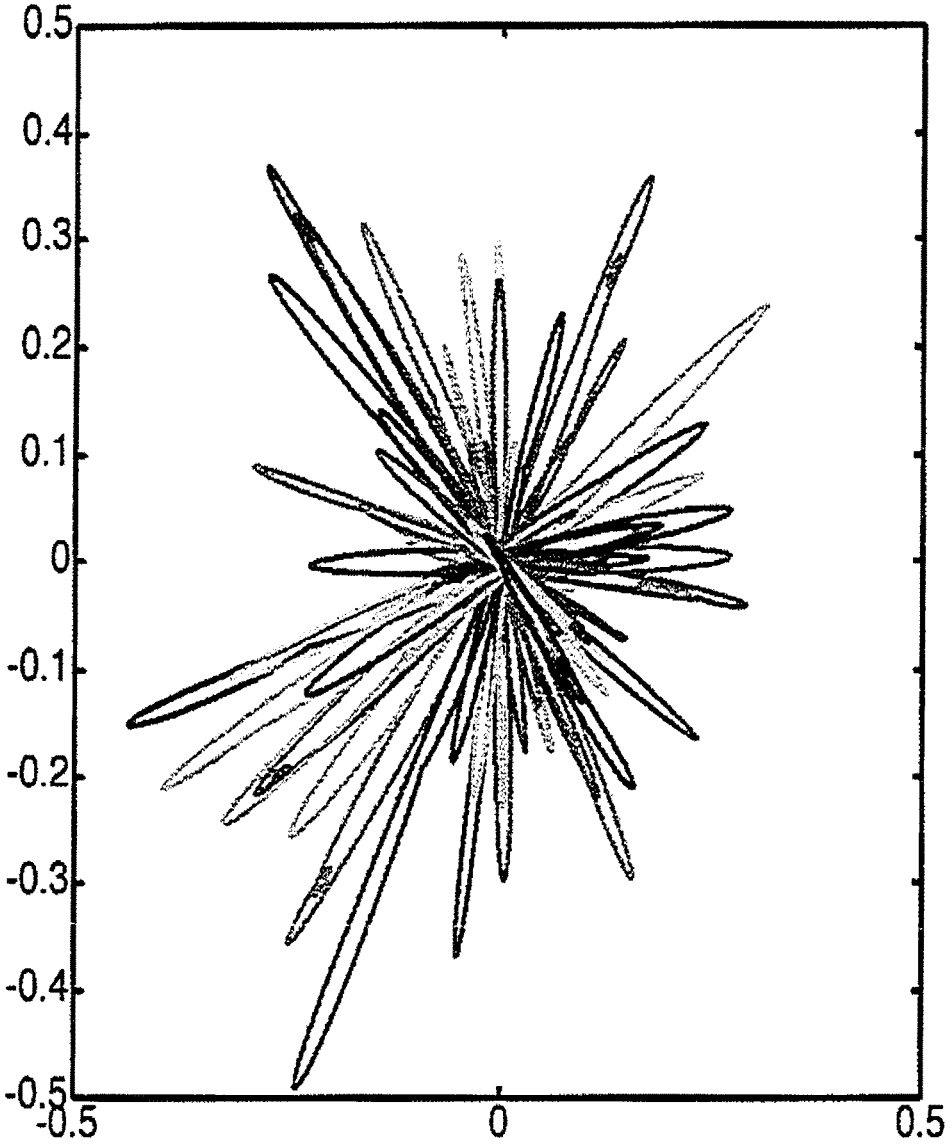
FIG. 11 illustrates example trajectories associated with shifted waveforms.

FIG. 10 illustrates example gradients and FIG. 11 illustrates example trajectories that shift a waveform so that the total delay may not be perceived by a typical human listener. In one embodiment, the X gradient may be used for music waveforms and the Y gradient may be N (e.g., ten) point shifted waveforms. Different shifts in time may be employed in different embodiments.

Figure 12:
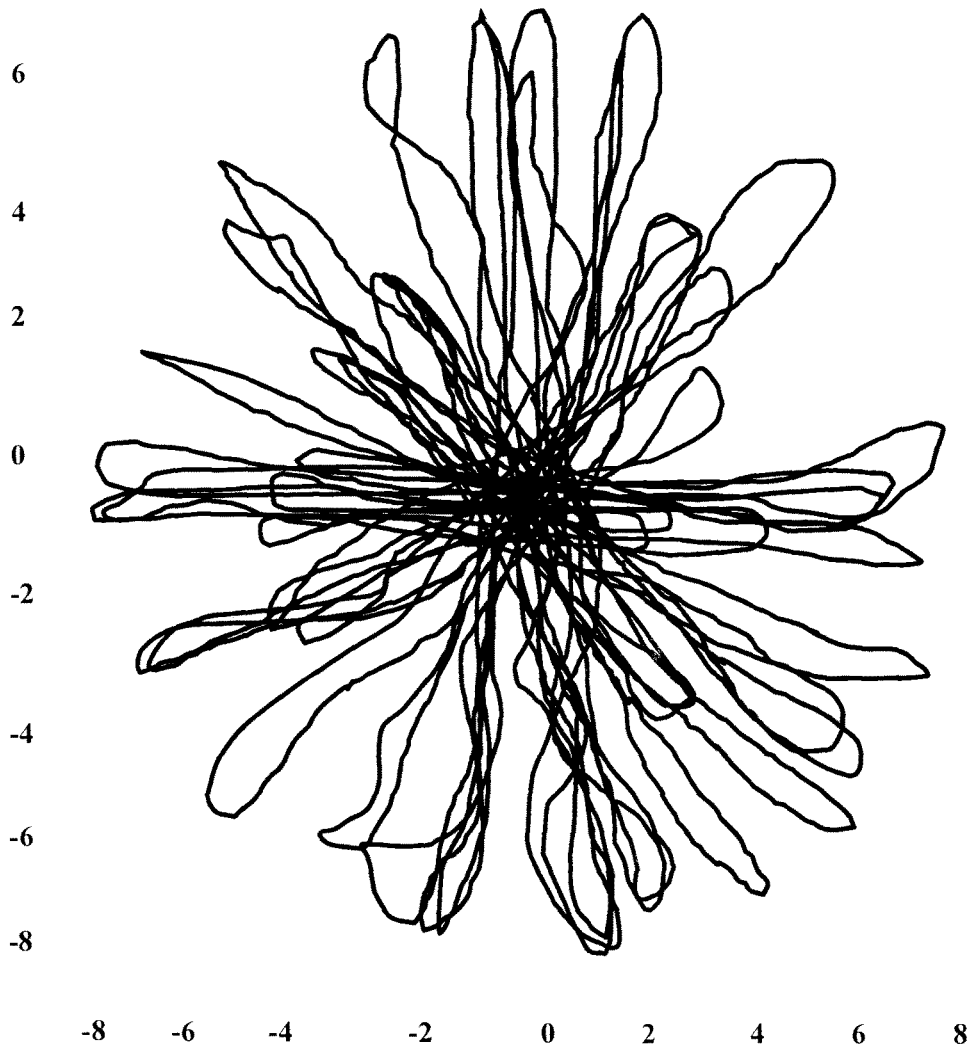
FIG. 12 illustrates an example trajectory associated with a dual-filtered waveform.

FIG. 12 illustrates example trajectories associated with dual-filtered waveforms. An initial audio waveform produced from the encoded music may be filtered into, for example, two bands. The two bands may be, for example, DC-1.5 kHz and 1.5 kHz-3 kHz. In one embodiment, the filtering may be selectively adapted during a scan. Two filters may produce two bands that sum together to produce the original waveform. The two different waveforms or bands may then be played on different gradient axes (e.g., one on X, one on Y). While two bands are described, a greater number of bands may be employed.

Figure 13:
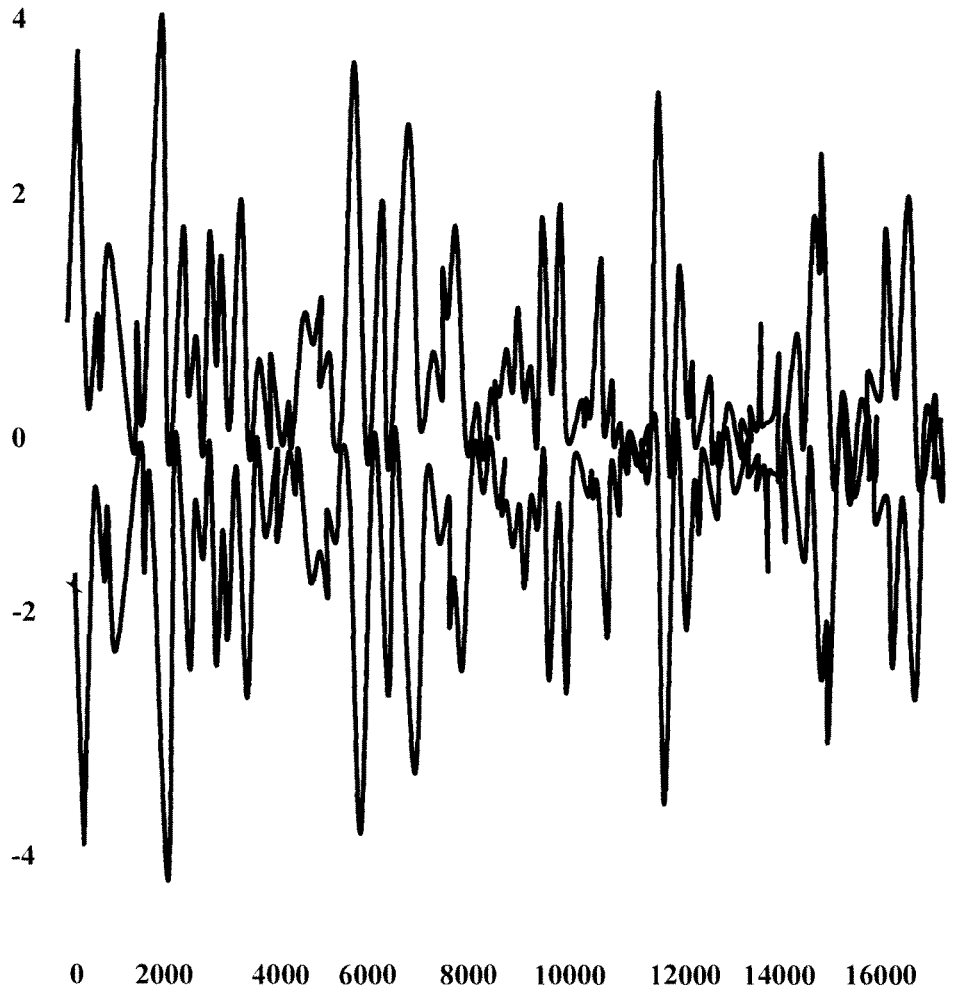
FIG. 13 illustrates example gradients associated with 3D radial trajectories.

FIG. 13 illustrates example gradients associated with 3D radial trajectories. A music segment is defined as Gr, where r is the radius of a 3D sphere. Gradients may then be calculated in x, y, and z directions using 3D rotational angles. In one embodiment, the 3D rotational angles may be uniformly distributed in 3D space. In one embodiment, Gx, Gy and Gz may be computed according to:

$$G_x=G_r\cos(m_d\phi)\sin(m_d\theta)$$

$$G_y=G_r\sin(m_d\phi)\sin(m_d\theta)$$

$$G_z=G_r\cos(m_d\theta)$$

The following includes definitions of selected terms employed herein. The definitions include various examples and/or forms of components that fall within the scope of a term and that may be used for implementation. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

"Computer-readable storage medium", as used herein, refers to a non-transitory medium that stores signals, instructions and/or data. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, an ASIC, a CD, other optical medium, a RAM, a ROM, a memory chip or card, a memory stick, and other media from which a computer, a processor or other electronic device can read.

"Logic", as used herein, includes but is not limited to hardware, firmware, software in execution on a machine, and/or combinations of each to perform a function(s) or an action(s), and/or to cause a function or action from another logic, method, and/or system. Logic may include a software controlled microprocessor, a discrete logic (e.g., ASIC), an analog circuit, a digital circuit, a programmed logic device, a memory device containing instructions, and so on. Logic may include one or more gates, combinations of gates, or other circuit components. Where multiple logical logics are described, it may be possible to incorporate the multiple logical logics into one physical logic. Similarly, where a single logical logic is described, it may be possible to distribute that single logical logic between multiple physical logics.

An "operable connection", or a connection by which entities are "operably connected", is one in which signals, physical communications, and/or logical communications may be sent and/or received. An operable connection may include a physical interface, an electrical interface, and/or a data interface. An operable connection may include differing combinations of interfaces and/or connections sufficient to allow operable control. For example, two entities can be operably connected to communicate signals to each other directly or through one or more intermediate entities (e.g., processor, operating system, logic, software). Logical and/or physical communication channels can be used to create an operable connection.

"User", as used herein, includes but is not limited to one or more persons, software, computers or other devices, or combinations of these.

Some portions of the detailed descriptions that follow are presented in terms of algorithms and symbolic representations of operations on data bits within a memory. These algorithmic descriptions and representations are used by those skilled in the art to convey the substance of their work to others. An algorithm, here and generally, is conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic, and so on. The physical manipulations create a concrete, tangible, useful, real-world result.

It has proven convenient at times, principally for reasons of common usage, to refer to these signals as bits, values, elements, symbols, characters, terms, numbers, and so on. It should be borne in mind, however, that these and similar terms are to be associated with the appropriate physical quantities and are merely convenient labels applied to these quantities. Unless specifically stated otherwise, it is appreciated that throughout the description, terms including processing, computing, determining, and so on, refer to actions and processes of a computer system, logic, processor, or similar electronic device that manipulates and transforms data represented as physical (electronic) quantities.

Example methods may be better appreciated with reference to flow diagrams. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 14:
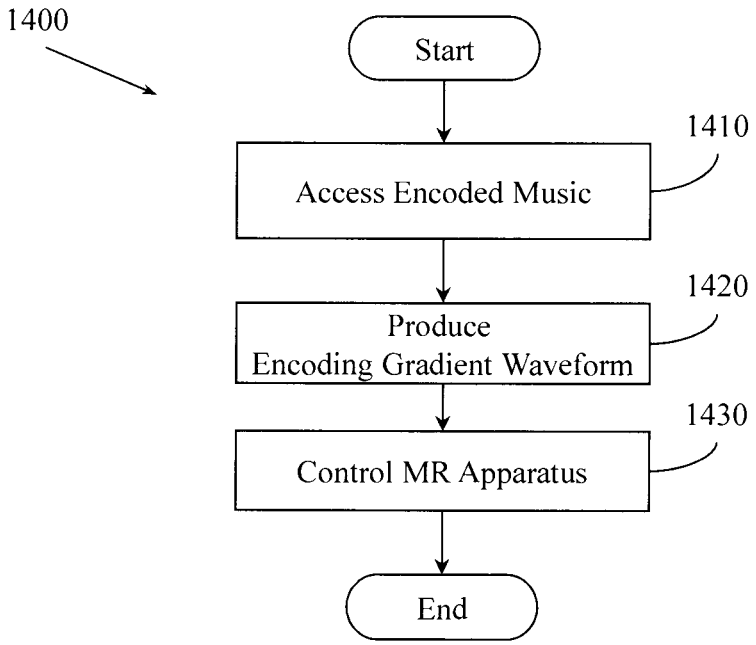
FIG. 14 illustrates an example method associated with producing gradient waveforms derived from music.

FIG. 14 illustrates a method 1400. Method 1400 includes, at 1410, accessing a piece of encoded music. The piece of encoded music may be, for example, an MP3 file. Accessing the piece of encoded music may include, for example, receiving the encoded music by a computer or network communication, receiving a pointer to the encoded music, reading the encoded music from a file, reading the encoded music from a data store, or other operation. In one embodiment, the encoded music may be pre-processed before producing the encoding gradient waveform. For example, the encoded music may be low pass filtered to remove signals above a first frequency (e.g., 2 kHz) from the piece of encoded music. The encoded music may also be resampled at a second frequency (e.g., 100 kHz) that is based on a gradient output raster time associated with the MR apparatus. In one embodiment, the resampling may be performed at a frequency that equals the gradient output raster time. The encoded music may be filtered then resampled, resampled then filtered, or processed in other ways in other orders.

Method 1400 also includes, at 1420, producing, from the piece of encoded music or from the filtered or resampled music, an encoding gradient waveform for use with an MRF procedure. In one embodiment, producing the encoding gradient waveform includes optimizing:

$$\min(\|G-s\|_2+\lambda\Sigma G+\beta\|K-K_0\|_2)$$

In another embodiment, producing the encoding gradient waveform includes optimizing:

$$\min(\|G-s\|_2+\lambda\Sigma G+\beta\|K-K_0\|_2)+Gm$$

G is the target gradient, s is a portion of the piece of encoded music, K is the vector of sampling points derived from s, and $K_0$ is the vector of equally distributed points between −Kmax and Kmax. Kmax is resolution/2/field of view. λ and β balance gradient fidelity, gradient refocusing, and trajectory coverage. In one embodiment, K is $K=\bar{\gamma}\Sigma H_t$, where γ is the gyromagnetic ratio, H is the gradient strength, and t is the time the gradient is applied.

Gm is a gradient moment that produces a zero net gradient. In one embodiment, GM is computed according to: $\Sigma G_r t_r=-\Sigma H_t$, where $G_r$ is a final target gradient, $t_r$ is the time index of the target gradient, H is the gradient strength of the moment that produces a zero net gradient, and t is the time at which the gradient is applied. Additional detail about how the encoding gradient waveform is produced in different embodiments is provided in connection with FIG. 15.

Method 1400 also includes, at 1430, controlling an MR apparatus to perform the MRF procedure using the encoding gradient waveform. Performing the MRF procedure using the encoding gradient waveform causes the MR apparatus to produce music recognizable as the piece of encoded music. The music may replace the traditional loud knocking noises with pleasant acoustic sounds. Being "recognizable" means that a person who listened to the encoded music through, for example, a stereo or MP3 player and who listened to the acoustic sounds produced in the bore by the MR apparatus would understand that the two pieces of music were the same piece of music. Empirically, the acoustic waveform produced by playing the encoded music using a music player (e.g., stereo, MP3 player) and the acoustic waveform produced by the MR apparatus will match to within a threshold. The threshold may be, for example, to within ten percent. When viewed together on an oscilloscope, a viewer would identify overlap and similarities between the waveforms.

The encoding gradient waveform may be employed in MRF procedures that use different gradients to produce different trajectories. For example, the MRF procedure may use the encoding gradient waveform in a 2D radial trajectory or in a 3D radial trajectory. In one embodiment, the MRF procedure uses the encoding gradient waveform while switching gradients in an orthogonal direction. In another embodiment, the MRF procedure uses the encoding gradient waveform while shifting one of the encoding gradient waveforms in time. In yet another embodiment, the MRF procedure uses the encoding gradient waveform in a dual-filtered procedure.

Recall that MRF facilitates simultaneously quantifying more than one MR parameter. Thus, in one embodiment, the MRF procedure uses the encoding gradient waveform to simultaneously quantify T1, T2, M0, or off-resonance, where T1 is spin-lattice relaxation, T2 is spin-spin relaxation, and M0 is the default or natural alignment to which spins align when placed in the main magnetic field. Given the flexibility provided by MRF, in one embodiment, the MRF procedure uses the encoding gradient waveform with variable flip angles or variable repetition times.

Figure 15:
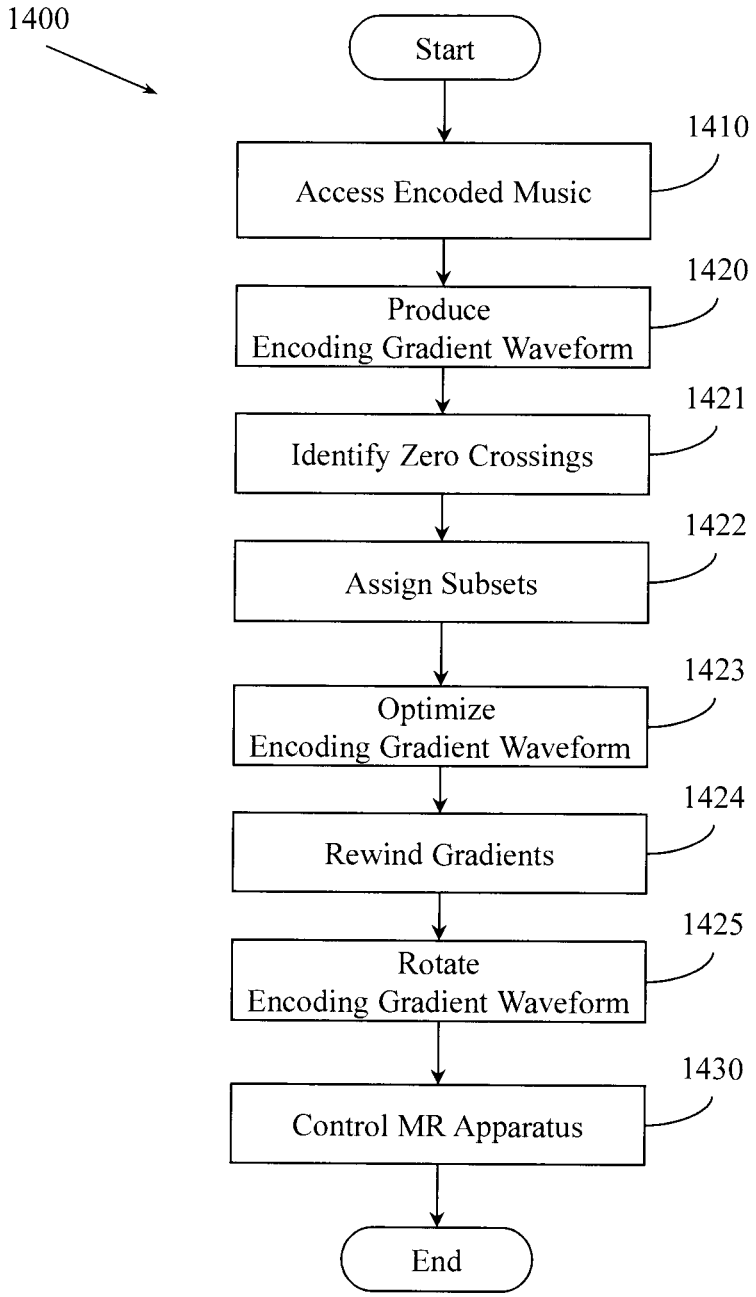
FIG. 15 illustrates an example method associated with producing gradient waveforms derived from music.

FIG. 15 illustrates another embodiment of method 1400 (FIG. 14). This embodiment includes accessing the encoded music at 1410, producing the encoding gradient waveform at 1420, and controlling the MR apparatus at 1430. In one embodiment, producing the encoding gradient waveform includes, at 1421, partitioning the encoding gradient waveform into a plurality of segments defined by zero crossings in the piece of encoded music. Once the encoding gradient waveform has been partitioned, different subsets of partitions may be assigned different tasks at 1422. For example, a first subset of the plurality of segments may be used for RF excitation and a second, disjoint subset of the plurality of segments may be used for k-space encoding gradients.

MR apparatus are actual physical machines that have actual physical limitations. Therefore, in one embodiment, optimizing the encoding gradient waveform at 1423 may include controlling the amplitude of the encoding gradient waveform to be less than the maximum gradient amplitude of the MR apparatus, or controlling the slew rate required to produce the encoding gradient waveform to be less than the maximum gradient slew rate of the MR apparatus. Additionally, optimizing the encoding gradient waveform at 1423 may include establishing a sampling trajectory for the encoding gradient waveform that covers at least N×N pixels in an $Mmm^2$ field of view. In one embodiment N may be 128 and M may be 300.

Method 1400 may also include, at 1424, rewinding the gradients. Rewinding the gradients may include, for example, adding an additional compensating moment as a short gradient waveform at the end of the readout gradient according to:

$$\Sigma G_r t_r = -\Sigma G_t.$$

This gradient may be kept short enough (e.g., 20 μs) to remain below the audible range.

Method 1400 may also include, at 1425, rotating an encoding gradient waveform. To facilitate rotating an encoding gradient waveform, a low frequency balanced trapezoidal gradient having a first percentage (e.g., 10%) of the maximum amplitude of the encoding gradient waveform may be produced. Method 1400 may then rotate the encoding gradient waveform and the low frequency balanced trapezoidal gradient in different TRs of the MRF procedure to produce different spatial encodings to encode more than a single line in k-space. In one embodiment, the music segment associated with the encoding gradient waveform may be rotated to produce two dimensional encoding. In another embodiment, the music segment may be rotated by 0.9 degrees per repetition time in the MRF procedure. In yet another embodiment, a music segment associated with the encoding gradient waveform may be rotated to produce three dimensional encoding.

While FIGS. 14 and 15 illustrate various actions occurring in serial, it is to be appreciated that various actions illustrated in FIGS. 14 and 15 could occur substantially in parallel. By way of illustration, a first process could access and convert encoded music, a second process could produce an optimized gradient waveform, a third process could produce derivative (e.g., rotated, shifted) gradient waveforms, and a fourth process could control an MR apparatus to produce music by performing an MRF procedure that uses the gradient waveform and the derivative gradient waveforms. While four processes are described, it is to be appreciated that a greater and/or lesser number of processes could be employed.

Figure 16:
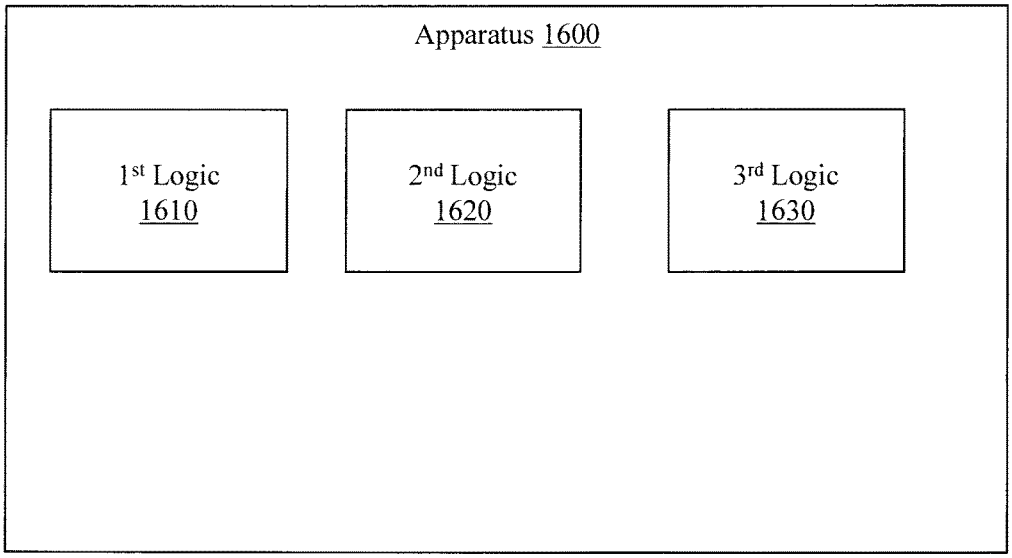
FIG. 16 illustrates an example apparatus associated with producing gradient waveforms derived from music.

FIG. 16 illustrates an apparatus 1600. Apparatus 1600 includes a first logic 1610 that converts a piece of encoded music to an encoding gradient associated with an MRF pulse sequence. The piece of encoded music may be, for example, an MP3 digital file. While an MP3 digital file is described, other types of encoded music may be accessed. MP3 refers to MPEG-1 or MPEG-2 Audio Layer III, and MPEG refers to Moving Pictures Expert Group. In one embodiment, the first logic 1610 filters or resamples the piece of encoded music before converting the piece of encoded music to the encoding gradient. The filtering or resampling may be performed in different orders.

Apparatus 1600 also includes a second logic 1620 that produces an optimized encoding gradient from the encoding gradient. In one embodiment, the second logic 1620 optimizes the encoding gradient with respect to amplitude, slew rate, and trajectory associated with the MR apparatus. For example, the encoding gradient may be optimized to produce a zero net moment while staying within the bounds of the maximum gradient amplitude and slew rate. In one embodiment, the second logic 1620 partitions the encoding gradient into a plurality of portions as a function of zero crossings of the encoded music. The plurality of portions may be separated into, for example, even and odd numbered segments. The second logic 1620 may then employ a first subset of the plurality of portions for RF excitation and may employ a second, disjoint subset of the plurality of portions for k-space encoding gradients.

Apparatus 1600 also includes a third logic 1630 that controls an MR apparatus to apply the MRF pulse sequence. Applying the MRF pulse sequence causes the MR apparatus to produce music related to the piece of encoded music. For example, the music produced by applying the MRF pulse sequence will be recognizable to a listener of both pieces of music.

Figure 17:
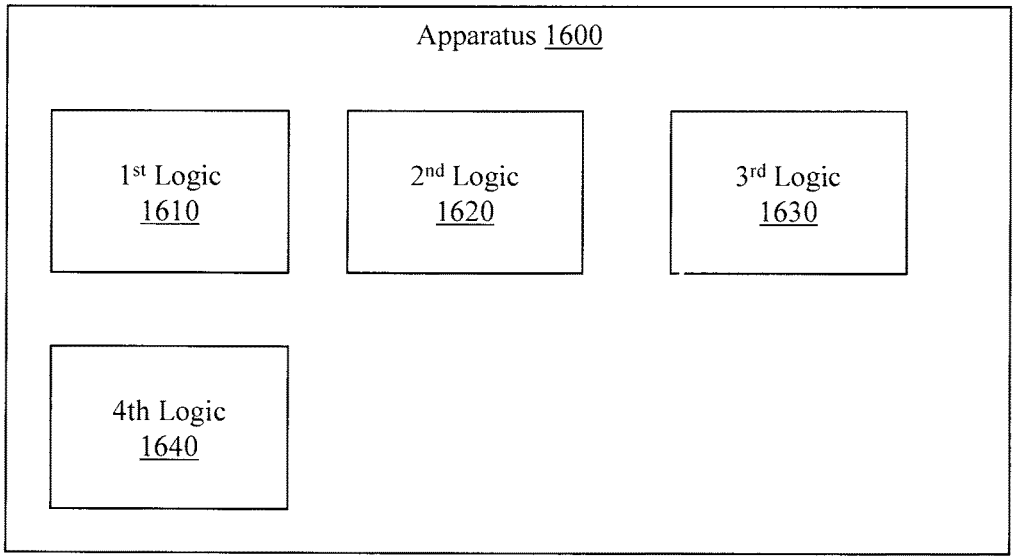
FIG. 17 illustrates an example apparatus associated with producing gradient waveforms derived from music.

FIG. 17 illustrates another embodiment of apparatus 1600 (FIG. 16). This embodiment also includes a fourth logic 1640. The fourth logic 1640 produces a derivative encoding gradient related to the optimized encoding gradient. The derivative encoding gradient may be formed by rotating or shifting the encoding gradient. The derivative encoding gradient facilitates producing a 2D trajectory, a 3D trajectory, a shifted trajectory, or a dual-filtered trajectory. In one embodiment, the third logic 1630 controls the MR apparatus to apply the encoding gradient and the derivative encoding gradient as part of the MRF pulse sequence.

Figure 18:
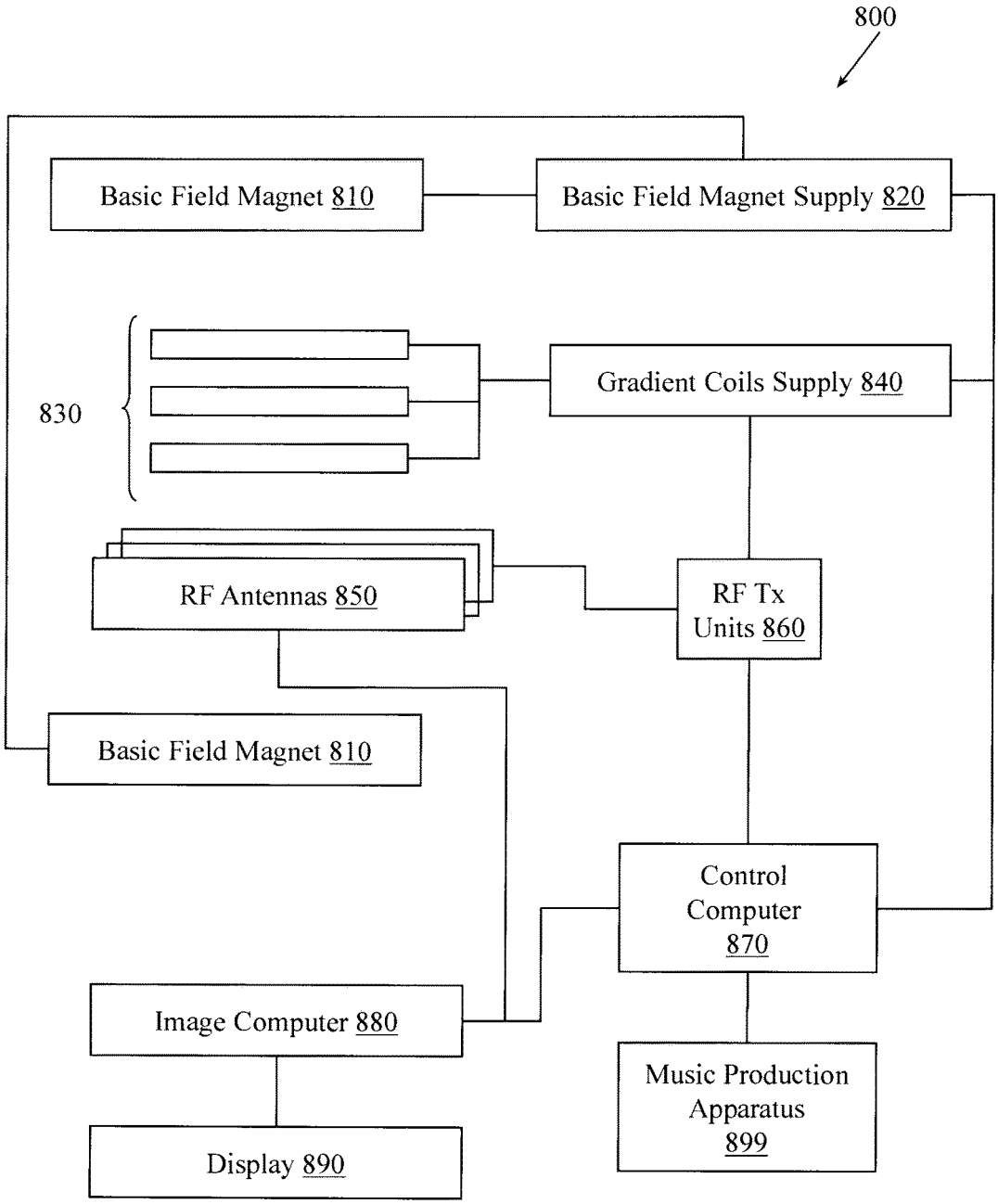
FIG. 18 illustrates an example MR apparatus.

FIG. 18 illustrates an example MR apparatus 1800 configured with a music production apparatus 1899 to facilitate MR fingerprinting using a pulse sequence that simultaneously quantifies MR parameters including T1, T2, M0, and proton density all while producing a pleasant sound in the bore. The music production apparatus 1899 may be configured with elements of example apparatus described herein and/or may perform example methods described herein. While music production apparatus 1899 is illustrated as part of MR apparatus 1800, in one example, music production apparatus 1899 may be a separate apparatus or apparatuses.

The apparatus 1800 includes a basic field magnet(s) 1810 and a basic field magnet supply 1820. Ideally, the basic field magnets 1810 would produce a uniform B0 field. However, in practice, the B0 field may not be uniform, and may vary over an object being analyzed by the MR apparatus 1800. MR apparatus 1800 may include gradient coils 1830 configured to emit gradient magnetic fields like $G_S$, $G_P$ and $G_R$. The gradient coils 1830 may be controlled, at least in part, by a gradient coils supply 1840. In some examples, the timing, strength, and orientation of the gradient magnetic fields may be controlled, and thus selectively adapted, during an MR procedure.

MR apparatus 1800 may include a set of RF antennas 1850 that generate RF pulses and that receive resulting NMR signals from an object to which the RF pulses are directed. In some examples, how the pulses are generated and how the resulting MR signals are received may be controlled and thus may be selectively adapted during an MR procedure. Separate RF transmission and reception coils can be employed. The RF antennas 1850 may be controlled, at least in part, by a set of RF transmission units 1860. An RF transmission unit 1860 may provide a signal to an RF antenna 1850.

The gradient coils supply 1840 and the RF transmission units 1860 may be controlled, at least in part, by a control computer 1870. In one example, the control computer 1870 may be programmed to control an NMR device as described herein. Conventionally, the MR signals received from the RF antennas 1850 can be employed to generate an image and thus may be subject to a transformation process like a two dimensional FFT that generates pixilated image data. The transformation can be performed by an image computer 1880 or other similar processing device. The image data may then be shown on a display 1890.

MRF facilitates not having to do conventional reconstruction of an image from MR signals received from the RF antennas 1850. Thus the RF energy applied to an object by apparatus 1800 need not be constrained to produce signals with substantially constant amplitudes or phases. Instead, system 1800 facilitates matching received signals to known signals for which a reconstruction, relaxation parameter, or other information is already available.

While FIG. 18 illustrates an example MR apparatus 1800 that includes various components connected in various ways, it is to be appreciated that other MR apparatus may include other components connected in other ways.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the invention is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

To the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

To the extent that the phrase "one of, A, B, and C" is employed herein, (e.g., a data store configured to store one of, A, B, and C) it is intended to convey the set of possibilities A, B, and C, (e.g., the data store may store only A, only B, or only C). It is not intended to require one of A, one of B, and one of C. When the applicants intend to indicate "at least one of A, at least one of B, and at least one of C", then the phrasing "at least one of A, at least one of B, and at least one of C" will be employed.

To the extent that the phrase "one or more of, A, B, and C" is employed herein, (e.g., a data store configured to store one or more of, A, B, and C) it is intended to convey the set of possibilities A, B, C, AB, AC, BC, ABC, AA . . . A, BB . . . B, CC . . . C, AA . . . ABB . . . B, AA . . . ACC . . . C, BB . . . BCC . . . C, or AA . . . ABB . . . BCC . . . C (e.g., the data store may store only A, only B, only C, A&B, A&C, B&C, A&B&C, or other combinations thereof including multiple instances of A, B, or C). It is not intended to require one of A, one of B, and one of C. When the applicants intend to indicate "at least one of A, at least one of B, and at least one of C", then the phrasing "at least one of A, at least one of B, and at least one of C" will be employed.

What is claimed is:

1. A method, comprising:

accessing a piece of encoded music;

producing, from the piece of encoded music, an encoding gradient waveform for use with a magnetic resonance fingerprint (MRF) procedure;

controlling a magnetic resonance (MR) apparatus to perform the MRF procedure using the encoding gradient, where performing the MRF procedure using the encoding gradient causes the MR apparatus to produce music recognizable as the piece of encoded music; and producing a low frequency balanced trapezoidal gradient having a first percentage of the maximum amplitude of the encoding gradient waveform.

2. The method of claim 1, where producing the encoding gradient waveform includes partitioning the encoding gradient waveform into a plurality of segments defined by zero crossings in the piece of encoded music.

3. The method of claim 2, comprising using a first subset of the plurality of segments for radio frequency (RF) excitation.

4. The method of claim 3, comprising using a second, disjoint subset of the plurality of segments fork-space encoding gradients.

5. The method of claim 1, comprising controlling the amplitude of the encoding gradient waveform to be less than the maximum gradient amplitude of the MR apparatus.

6. The method of claim 1, comprising controlling the slew rate required to produce the encoding gradient waveform to be less than the maximum gradient slew rate of the MR apparatus.

7. The method of claim 1, comprising establishing a sampling trajectory for the encoding gradient waveform that covers at least N×N pixels in an Mmm2 field of view.

8. The method of claim 7, N being 128, M being 300.

9. The method of claim 1, comprising rotating the encoding gradient waveform and the low frequency balanced trapezoidal gradient in different repetition times (TR) of the MRF procedure to produce different spatial encodings to encode more than a single line in k-space.

10. The method of claim 9, the first percentage being ten percent.

11. The method of claim 1, where the MRF procedure uses the encoding gradient waveform in a two dimensional radial trajectory.

12. The method of claim 1, where the MRF procedure uses the encoding gradient waveform while switching gradients in an orthogonal direction.

13. The method of claim 1, where the MRF procedure uses the encoding gradient waveform while shifting one of the encoding gradient waveforms in time.

14. The method of claim 1, where the MRF procedure uses the encoding gradient waveform in a dual-filtered procedure.

15. The method of claim 1, where the MRF procedure uses the encoding gradient waveform in a three dimensional radial trajectory.

16. The method of claim 1, where the MRF procedure uses the encoding gradient waveform to simultaneously quantify T1, T2, M0, or offresonance, where T1 is spin-lattice relaxation, T2 is spin-spin relaxation, and M0 is the default or natural alignment to which spins align when placed in the main magnetic field.

17. The method of claim 1, where the MRF procedure uses the encoding gradient waveform with variable flip angles or variable repetition times.

18. A method, comprising:

accessing a piece of encoded music, producing, from the piece of encoded music, an encoding gradient waveform for use with a magnetic resonance fingerprint (MRF) procedure, controlling a magnetic resonance (MR) apparatus to perform the MRF procedure using the encoding gradient waveform, where performing the MRF procedure using the encoding gradient waveform causes the MR apparatus to produce music recognizable as the piece of encoded music, producing a piece of low pass filtered music from the piece of encoded music by low pass filtering the piece of encoded music to remove signals above a first frequency from the piece of encoded music, producing a piece of resampled music from the piece of low pass filtered music by resampling the piece of low pass filtered music at a second frequency that is based on a gradient output raster time associated with the MR apparatus, and where the encoding gradient waveform is produced from the piece of resampled music.

19. The method of claim 18, the first frequency being 2 kHz and the second frequency being 100 kHz.

20. A method, comprising:

accessing a piece of encoded music, producing, from the piece of encoded music, an encoding gradient waveform for use with a magnetic resonance fingerprint (MRF) procedure, controlling a magnetic resonance (MR) apparatus to perform the MRF procedure using the encoding gradient waveform, where performing the MRF procedure using the encoding gradient waveform causes the MR apparatus to produce music recognizable as the piece of encoded music, producing a piece of resampled music from the piece of encoded music by resampling the piece of encoded music at a second frequency that is based on a gradient output raster time associated with the MR apparatus, and producing a piece of low pass filtered music from the piece of resampled music by low pass filtering the piece of resampled music to remove signals above a first frequency from the resampled music, where the encoding gradient waveform is produced from the piece of low pass filtered music.

21. The method of claim 20, the first frequency being 2 kHz and the second frequency being 100 kHz.

22. A method, comprising:

accessing a piece of encoded music;

producing, from the piece of encoded music, an encoding gradient waveform for use with a magnetic resonance fingerprint (MRF) procedure; and controlling a magnetic resonance (MR) apparatus to perform the MRF procedure using the encoding gradient waveform, where performing the MRF procedure using the encoding gradient waveform causes the MR apparatus to produce music recognizable as the piece of encoded music, where producing the encoding gradient waveform includes optimizing:

$$\min(\|G-s\|_2+\lambda\Sigma G+\beta\|K-K_0\|_2)$$

where

G is a target gradient, s is a portion of the piece of encoded music,

K is the vector of sampling points derived from s, $K_0$ is the vector of equally distributed points between −Kmax and Kmax, Kmax is resolution/2/field of view, and λ and β balance gradient fidelity, gradient refocusing, and trajectory coverage.

23. The method of claim 22, where K is:

$$K=\bar{\gamma}\Sigma H_t,$$

Where γ is the gyromagnetic ratio,

Where H is the gradient strength, and

Where t is the time the gradient is applied.

24. A method, comprising:

accessing a piece of encoded music;

producing, from the piece of encoded music, an encoding gradient waveform for use with a magnetic resonance fingerprint (MRF) procedure; and controlling a magnetic resonance (MR) apparatus to perform the MRF procedure using the encoding gradient waveform, where performing the MRF procedure using the encoding gradient waveform causes the MR apparatus to produce music recognizable as the piece of encoded music, where producing the encoding gradient waveform includes optimizing:

$$\min(\|G-s\|_2+\lambda\Sigma G+\beta\|K-K_0\|_2)+Gm$$

where:

G is a target gradient, s is a portion of the piece of encoded music,

K is the vector of sampling points derived from s, $K_0$ is the vector of equally distributed points between −Kmax and Kmax, Kmax is resolution/2/field of view, λ and β balance gradient fidelity, gradient refocusing, and trajectory coverage, and Gm is a gradient moment that produces a zero net gradient.

25. The method of claim 24, where Gm is computed according to:

$$\Sigma G_r t_r=-\Sigma H_t$$

where $G_r$ is the final target gradient, where $t_r$ is the time index of the target gradient, where H is the gradient strength of the moment that produces a zero net gradient, and where t is the time at which the gradient is applied.

26. A method, comprising:

accessing a piece of encoded music;

producing, from the piece of encoded music, an encoding gradient waveform for use with a magnetic resonance fingerprint (MRF) procedure;

controlling a magnetic resonance (MR) apparatus to perform the MRF procedure using the encoding gradient waveform, where performing the MRF procedure using the encoding gradient waveform causes the MR apparatus to produce music recognizable as the piece of encoded music;

rotating a music segment associated with the encoding gradient waveform to produce two dimensional encoding; and rotating the music segment by 0.9 degrees per repetition time in the MRF procedure.

27. A method, comprising:

accessing a piece of encoded music;

producing, from the piece of encoded music, an encoding gradient waveform for us with a magnetic resonance fingerprint (MRF) procedure;

controlling a magnetic resonance (MR) apparatus to perform the MRF procedure using the encoding gradient waveform, where performing the MRF procedure using the encoding gradient waveform causes the MR apparatus to produce music recognizable as the piece of encoded music; and rotating a music segment associated with the encoding gradient waveform to produce three dimensional encoding.

28. A method, comprising:

accessing a piece of digital music;

filtering and resampling the piece of digital music to produce filtered and resampled digital music;

producing, from the filtered and resampled digital music, an encoding gradient waveform for use with a magnetic resonance fingerprint (MRF) procedure;

optimizing the encoding gradient waveform with respect to amplitude, slew rate, and trajectory associated with a magnetic resonance (MR) apparatus that will perform the MRF procedure;

creating one or more derivatives of the encoding gradient waveform by shifting or rotating the encoding gradient waveform; and employing the encoding gradient waveform and the one or more derivatives in an MRF procedure, where employing the encoding gradient waveform and the one or more derivatives in the MRF procedure cause the MR apparatus to play music related to the piece of digital music.

29. An apparatus, comprising:

a first logic that converts a piece of encoded music to an encoding gradient associated with a magnetic resonance fingerprinting (MRF) pulse sequence;

a second logic that produces an optimized encoding gradient from the encoding gradient;

a third logic that controls MR the apparatus to apply the MRF pulse sequence, where applying the MRF pulse sequence causes the MR apparatus to produce music related to the piece of encoded music; and a fourth logic that produces a derivative encoding gradient from the optimized encoding gradient by rotating or shifting the encoding gradient, where the derivative encoding gradient facilitates producing a two dimensional trajectory, a three dimensional trajectory, a shifted trajectory, or a dual-filtered trajectory.

30. The apparatus of claim 29, where the first logic filters or resamples the piece of encoded music before converting the piece of encoded music to the encoding gradient.

31. The apparatus of claim 30, where the second logic optimizes the encoding gradient with respect to amplitude, slew rate, and trajectory associated with the MR apparatus.

32. The apparatus of claim 31, where the second logic partitions the encoding gradient into a plurality of portions as a function of zero crossings of the encoded music, and where the second logic employs a first subset of the plurality of portions for radio frequency (RF) excitation and employs a second, disjoint subset of the plurality of portions for k-space encoding gradients.

33. The apparatus of claim 29, where the third logic controls the MR apparatus to apply the encoding gradient and the derivative encoding gradient as part of the MRF pulse sequence.

* * * * *